US009108116B2

(12) United States Patent
Swartz et al.

(10) Patent No.: US 9,108,116 B2
(45) Date of Patent: Aug. 18, 2015

(54) CONTAINER WITH ARTICULATABLE STATUETTE

(71) Applicant: Paul Swartz, Botkins, OH (US)

(72) Inventors: Paul Swartz, Botkins, OH (US); Nathaniel Jonathan Baugh, Wapakoneta, OH (US)

( * ) Notice: Subject to any disclaimer, the term of this patent is extended or adjusted under 35 U.S.C. 154(b) by 325 days.

(21) Appl. No.: 13/633,907

(22) Filed: Oct. 3, 2012

(65) Prior Publication Data

US 2014/0094082 A1 Apr. 3, 2014

(51) Int. Cl.
*A63H 33/00* (2006.01)
*A63H 3/50* (2006.01)

(52) U.S. Cl.
CPC ..... *A63H 3/50* (2013.01); *A63H 33/003* (2013.01)

(58) Field of Classification Search
CPC ..... A63H 3/00; A63H 3/003; A63H 3/005; A63H 3/50; A63H 33/00; A63H 33/003
USPC ..... 446/72, 73, 76, 310, 321, 376, 487
See application file for complete search history.

(56) References Cited

U.S. PATENT DOCUMENTS

| | | | | |
|---|---|---|---|---|
| 677,723 | A | 7/1901 | Walters | |
| 1,347,696 | A | 7/1920 | Grgic | |
| 2,972,834 | A | 9/1955 | Bacon | |
| 2,858,644 | A | 11/1958 | Derham | |
| 3,763,591 | A | 10/1973 | Fontana | |
| 3,945,640 | A * | 3/1976 | Denmark | 273/288 |
| 4,407,504 | A | 10/1983 | Popov | |
| 4,456,384 | A * | 6/1984 | Murakami | 368/10 |
| 4,482,256 | A * | 11/1984 | Matsuda | 368/10 |
| 4,571,199 | A * | 2/1986 | Murakami | 446/73 |
| 4,575,348 | A | 3/1986 | Wiggs et al. | |
| D286,800 | S * | 11/1986 | Maruyama | D21/584 |
| 4,673,373 | A * | 6/1987 | Herring et al. | 446/378 |
| 4,682,969 | A * | 7/1987 | Choy et al. | 446/279 |
| 4,708,687 | A * | 11/1987 | Goldberg et al. | 446/269 |
| 4,798,555 | A | 1/1989 | Schaub et al. | |
| 4,881,915 | A | 11/1989 | Liaw | |
| 4,964,831 | A * | 10/1990 | Wolff | 446/75 |
| 5,213,538 | A * | 5/1993 | Willett | 446/4 |
| 6,086,446 | A * | 7/2000 | Arriola | 446/376 |
| 6,176,705 | B1 * | 1/2001 | Garvey et al. | 434/284 |
| 6,719,606 | B1 * | 4/2004 | Mukensturm | 446/369 |
| 7,008,289 | B2 | 3/2006 | Norman | |

(Continued)

FOREIGN PATENT DOCUMENTS

| | | | |
|---|---|---|---|
| EP | 2116289 A1 * | 11/2009 | |
| GB | 2184663 A * | 7/1987 | |

(Continued)

OTHER PUBLICATIONS

Form PCT/ISA/220.

*Primary Examiner* — Gene Kim
*Assistant Examiner* — Alyssa Hylinski
(74) *Attorney, Agent, or Firm* — Woodard, Emhardt, Moriarty, McNett & Henry LLP

(57) ABSTRACT

A toy including a ball shaped container removably mounted atop a stand. The container may be opened with the top portion of the container being unfolded creating an erect figurine. The bottom half of the container is inverted atop the stand and has a rotatable platform to removably support the figurine in the erect position.

11 Claims, 8 Drawing Sheets

(56) References Cited

U.S. PATENT DOCUMENTS

| | | | | |
|---|---|---|---|---|
| 7,731,563 | B2 * | 6/2010 | Saucier | 446/487 |
| 2002/0098770 | A1 | 7/2002 | Mesch | |
| 2009/0053968 | A1 | 2/2009 | Hui | |
| 2009/0176438 | A1 | 7/2009 | Meno | |
| 2010/0304637 | A1 | 12/2010 | Bullock | |

FOREIGN PATENT DOCUMENTS

| | | | |
|---|---|---|---|
| JP | 2007-222874 | | 8/1995 |
| JP | 2001091671 A | * | 4/2001 |

* cited by examiner

CONTAINER WITH ARTICULATABLE STATUETTE

BACKGROUND OF THE INVENTION

1. Field of the Invention

The present invention relates generally to the field of toys having figurines concealed within a container.

2. Description of the Prior Art

The familiar Jack-In-The-Box includes a figure, such as a clown, mounted on a helical spring enclosed within a box. Once the lid of the box is open, the clown springs upward. An example is shown in U.S. Patent Application Publication US2010/0304637 of Bullock. Another pop-up toy is shown in U.S. Pat. No. 2,858,644 of Derham. Another example is the puppet type figure toy disclosed in U.S. Pat. No. 3,763,591 of Fontana wherein the puppet is contained within a cylindrical container with the puppet being collapsible within the container and the puppet's hat forming at least a partial enclosure for the top of the container when the puppet is collapsed. Other examples of erectable figures are disclosed in the U.S. Pat. No. 4,575,348 of Wiggs, U.S. Pat. No. 4,881,915 of Liaw and U.S. Pat. No. 7,008,289 of Norman. Despite the toys disclosed in the above-identified patents, there is still a need for a new and attractive toy that may be enclosed in a container with the figurine then being erected as the container opens. The movable appendages of the figurine disclosed herein adds to the attractiveness of the toy and further, the figurine may be mounted on a rotatable portion of the container which, in turn, is mounted to a stand. Portions of the figurine form the outside container surface.

SUMMARY OF THE INVENTION

One embodiment of the present invention is a toy comprising a container with a bottom portion and a top portion. The container bottom portion has a hollow interior. The container top portion is releasably mountable to the bottom portion forming the container. The top portion forms a figurine having a collapsed position and an erect position. The figurine has a main body with articulate joints that may be manually articulated to position the figurine in the collapsed position and in the erect position. The figurine has an outwardly facing surface when in the collapsed position which is alignable with the outside surface of the bottom portion to cooperatively form the container concealing the figurine. The top portion and the bottom portion are releasably lockable together when the figurine is in the collapsed position with the figurine being mountable on the bottom portion and also separable from the bottom portion.

It is an object of the present invention to provide a new and improved toy having a collapsible state when positioned in a container and an erectable state once the container is opened.

A further object of the present invention is to provide a container having an erectable figurine with movable appendages.

Yet another object of the present invention is to provide a new and improved toy.

Related objects and advantages of the present invention will be apparent from the following description.

DESCRIPTION OF THE PREFERRED EMBODIMENT

Figure 1:
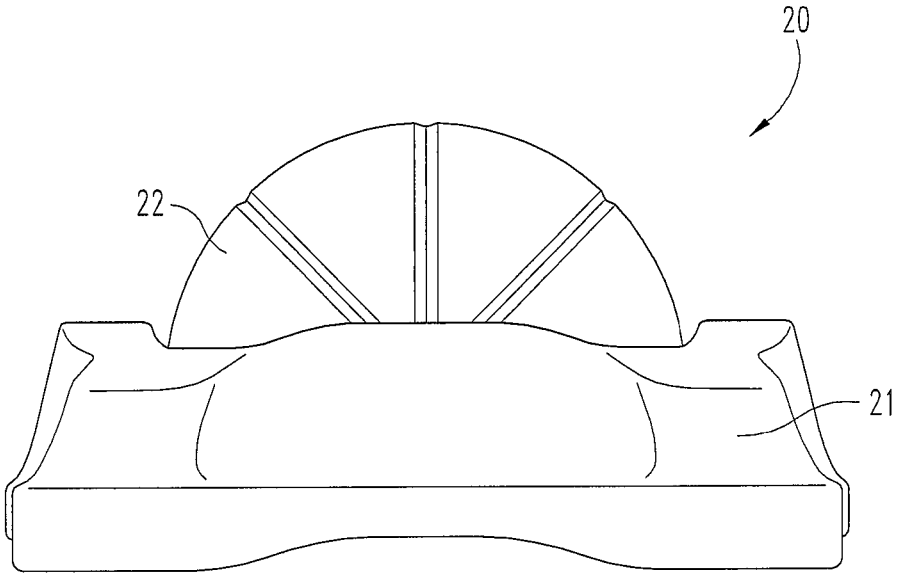
FIG. 1 is a front view of a toy having a round container mounted to a stand.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
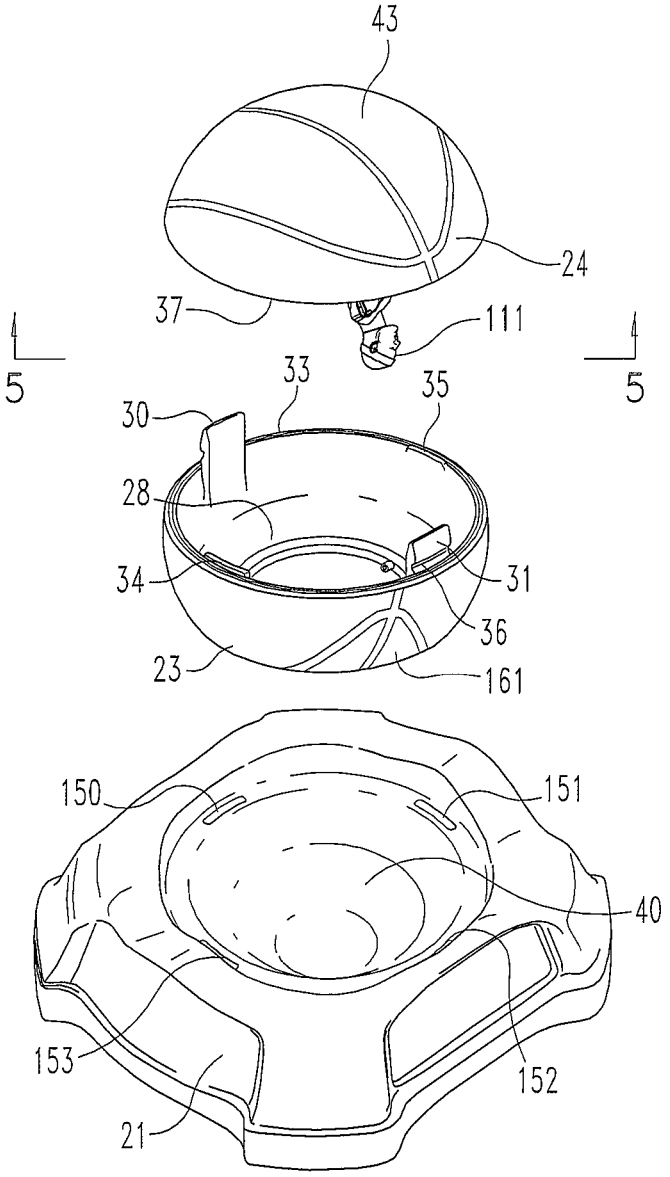
FIG. 2 is a front perspective and exploded view of the container removed from the stand with the container top portion separated from the container bottom portion.
Figure 3:
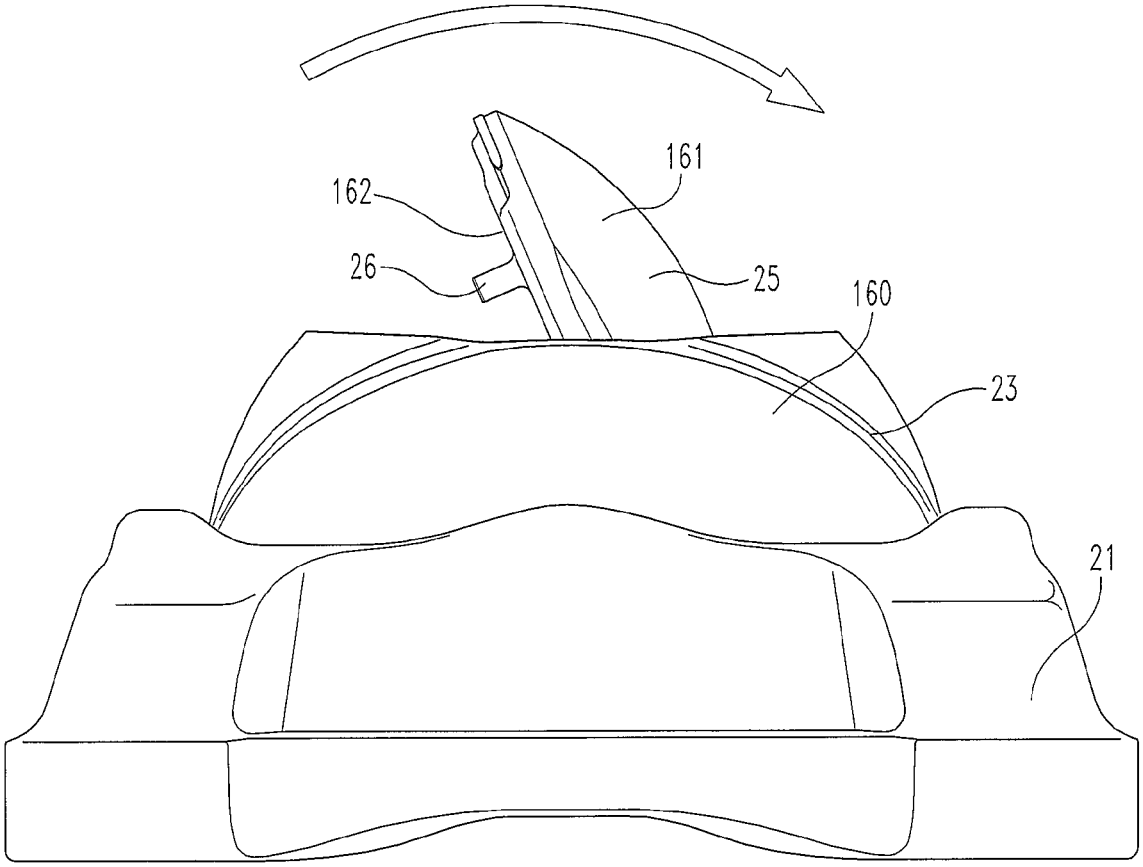
FIG. 3 is a enlarged side view of the container bottom portion inverted and then mounted to the stand with the container bottom portion having a rotatable platform moving to its figurine mounting position.
Figure 4:
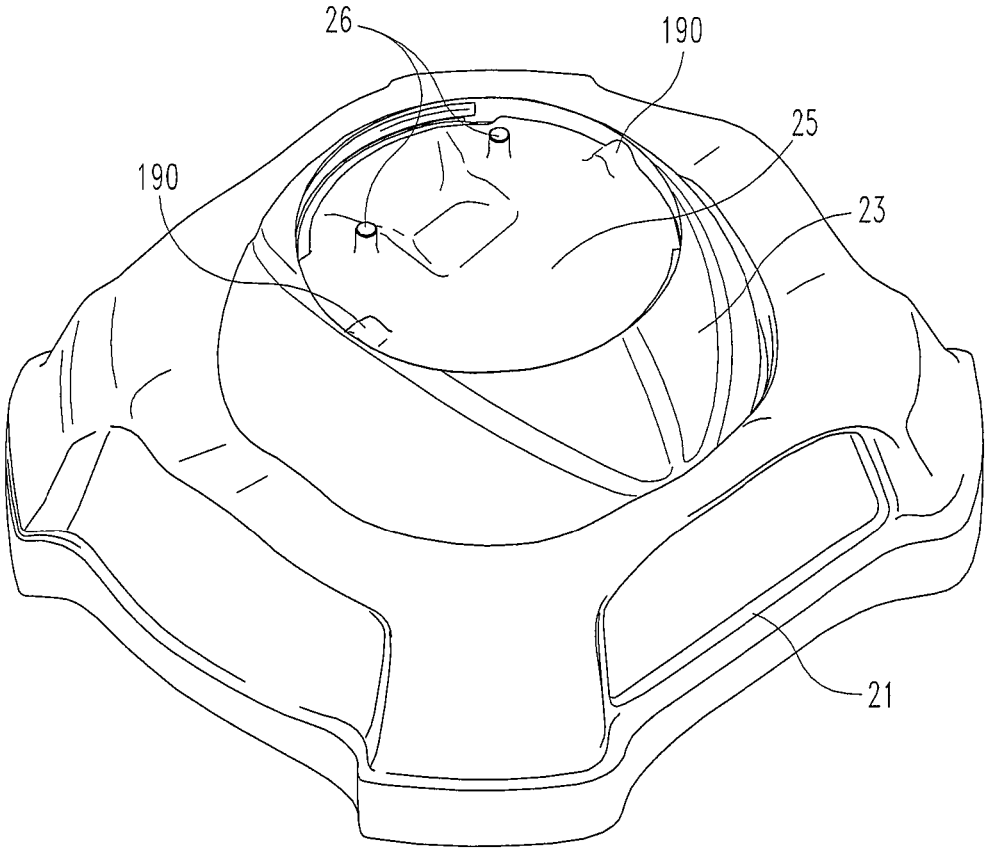
FIG. 4 is a top perspective view of the container bottom portion mounted to the stand.

In FIG. 1, there is shown a toy 20 having a container 22 removably mounted to stand 21. Container 22 has a container bottom portion 23 (FIG. 2) and a container top portion 24 movable apart from each other with the container 22 also being removable from stand 21. The container bottom portion 23 may be inverted (FIG. 3) and mounted to stand 21 while the container top portion 24 is separated therefrom. A platform 25 (FIG. 3) is rotatably mounted to container bottom portion 23, as shown by the arrow in FIG. 3, and forms a part thereof. Platform 25 has a pair of pegs 26 (FIGS. 3 & 4) projectable upward providing a mount for the container top portion 24 (FIG. 6) which is expandable to an erect figurine or statute. Platform has a curved surface 161 (FIG. 3) which blends into the remaining curved surface 160 of the container bottom portion 23 when the platform is rotated to conceal pegs 26 and a flat surface 162 facing upward when platform 25 is rotated to position pegs 26 to extend upwardly. Platform 25 is rotatably mounted to container bottom portion 23 by conventional pin/socket combinations 190 (FIG. 4).

Figure 5:
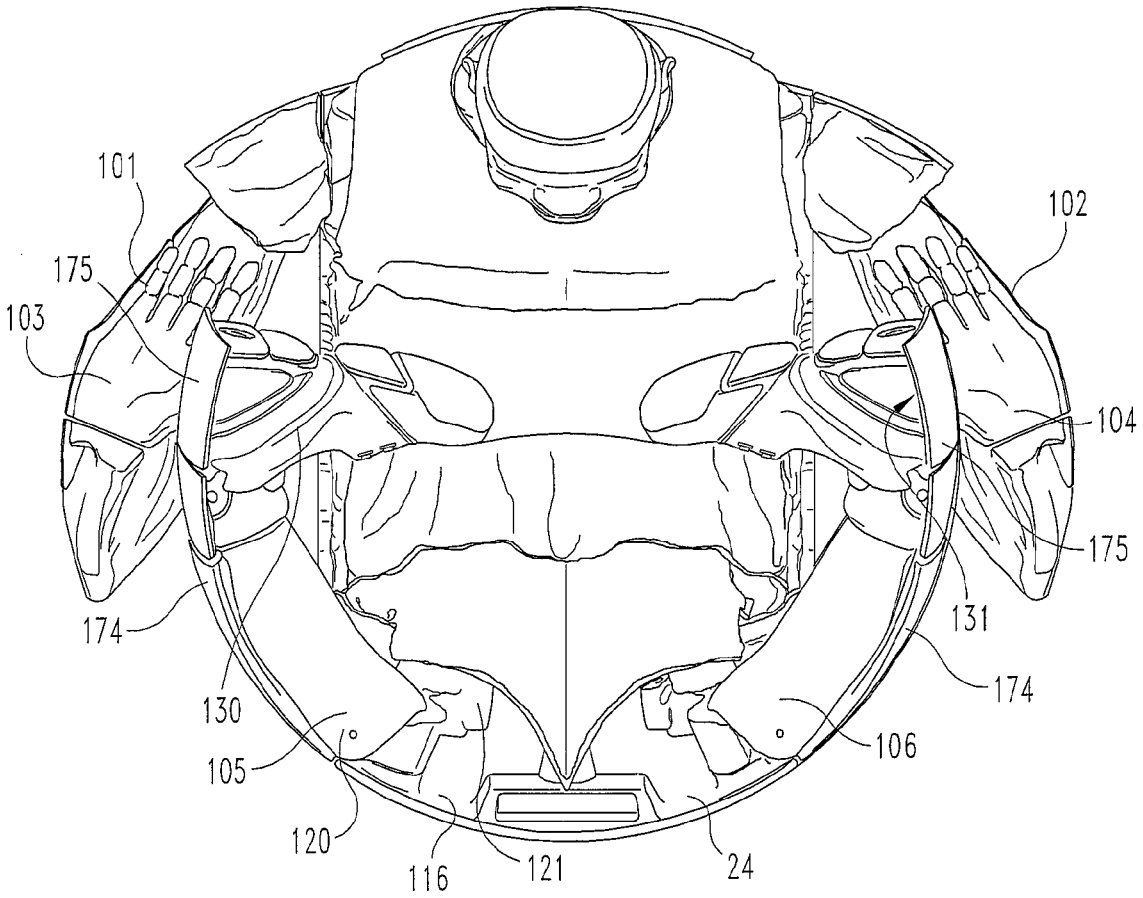
FIG. 5 is an enlarged bottom view looking in the direction of arrows 5-5 of FIG. 2 and showing the arms of the figurine partially expanded.

In the design shown in FIGS. 5-.8, the container top portion 24 is expandable or unfolded to represent a statute 27 of a person having feet with peg holes located in the soles of the feet to receive pegs 26 thereby holding the figurine in an erect position. The present invention includes a variety of figurines or statuettes in lieu of the person depicted in FIGS. 5-8. For example, any type of animal, vehicle or other object with movable members may be formed by the container top portion 24.

In the drawings, container 22 is configured as a round ball although it is to be understood that other shapes of the container are contemplated and included in the present invention. For example, container 22 may have an elliptical shape, such as, a football. Any number of shapes of the container are possible including a three dimensional pyramid, cube or a cylinder. The container bottom portion 23 has a hollow interior 28 (FIG. 2) into which a member 29 of the figurine formed by the container top portion may project when the container top portion and container bottom portion are mounted together to conceal the figurine. In the case of the figurine depicted in FIGS. 5-8, the member 111 of the figurine is the head of the depicted person.

In the drawings, container 22 has the form of a sphere. Thus, stand 21 includes an upwardly opening cavity 40 (FIG. 2) having a complementary smooth upwardly facing surface to receive the rounded and half spherical outer surface 43 of container top portion 24 or the rounded and half spherical outer surface 161 of container bottom portion 23 depending upon which portion of the container is seated in cavity 40. Container 22 sits loosely within cavity 40 and may be removed therefrom simply by moving the container upwardly from the stand. The outer surface of the container top portion 24 and container bottom portion 23 are smooth and alignable so that when portions 23 and 24 are connected together they form a rounded and spherical shell.

Container bottom portion 23 has a pair of hooked shaped tabs 30 and 31 (FIG. 2) having proximal ends integrally secured to the inner surface forming cavity 28. Tabs 30 and 31 project upwardly above the circumferentially extending top edge 33 and are positioned 180 degrees apart. Each tab 30 and 31 has a hook shape with an outwardly facing recess 36 located inwardly of the distal end of each tab to matingly extend into sockets formed in the container top portion 24. Tabs 30 and 31 and the sockets in top portion 24 releasably hold the portions 23 and 24 together. The side wall forming bottom portion 23 is sufficiently flexible to allow tabs to be squeezed toward each other so tabs 30 and 31 disengage top portion 24.

Ridges 34 and 35 have proximal ends integrally connected to the interior surface of container bottom portion 23 and are located 180 degrees apart on edge 33 and spaced between tabs 30 and 31 to be positioned inwardly of the downwardly facing circumferential edge 37 of container top portion 24 securing portions 23 and 24 together.

Stand 21 (FIG. 2) has four slots 150-153 to receive tabs 30 and 31 and ridges 34 and 35 when container bottom portion 23 is inverted and mounted atop stand 21. Thus, tabs 30 and 31 extend respectively into slots 150 and 152 whereas ridges 34 and 35 extend respectively into slots 151 and 153 thereby limiting relative motion between container bottom portion 23 and stand 21 when the container bottom portion is inverted and mounted atop the stand.

The figurine formed by the container top portion is that of a man with the figurine being a part of the container top portion. When in a completely folded condition, the only portion of the figurine that extends beyond the smooth outer surface 43 and edge 37 (FIG. 2) of container top portion 24 is the head 111 of a man which is received into the hollow interior 28 of the container bottom portion when container portions 23 and 24 are snapped together.

Figure 6:
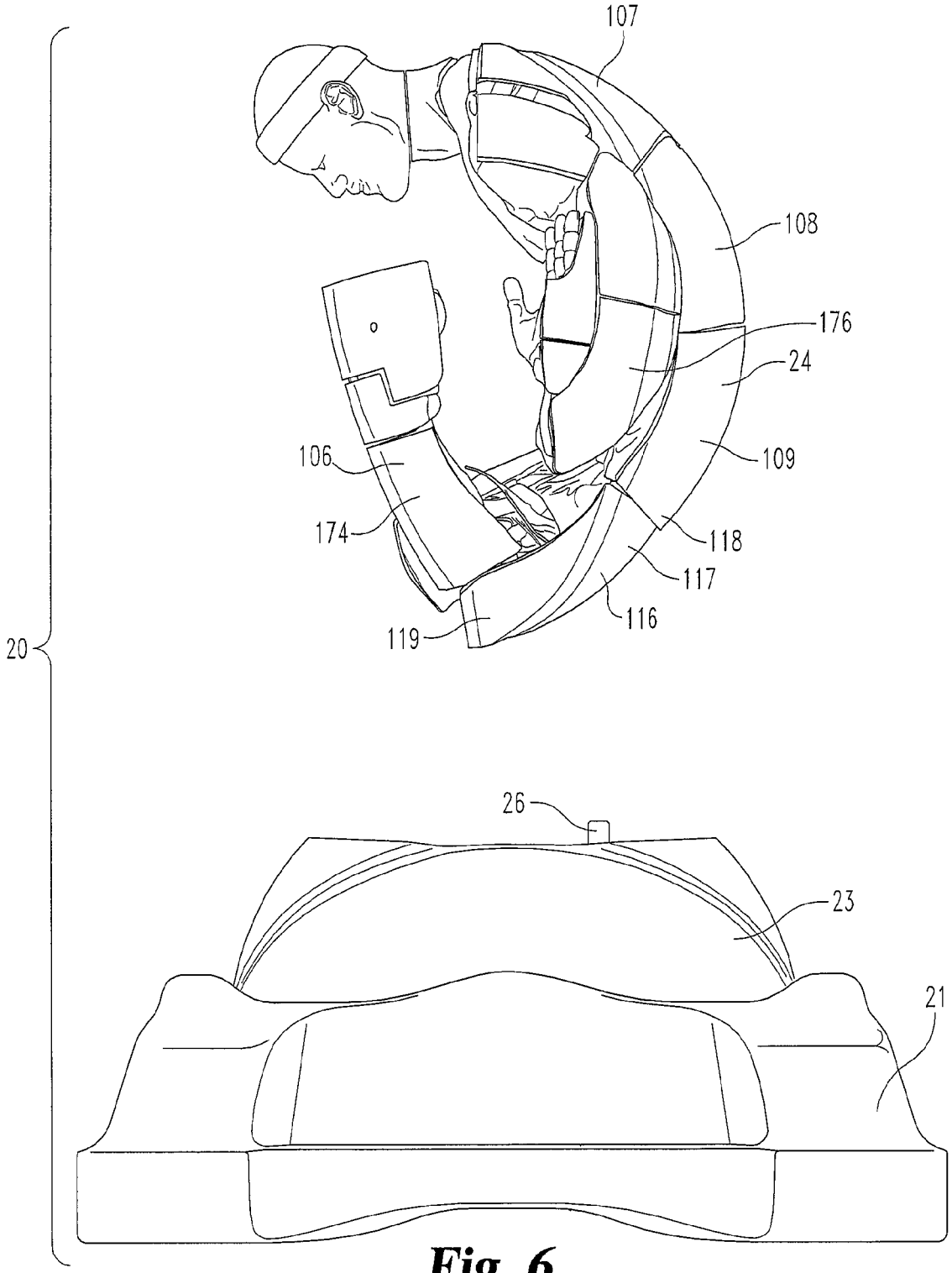
FIG. 6 is an enlarged side view of the toy with the container bottom portion mounted to the stand and the container top portion separated therefrom and expanding from the collapsed position to a partially expanded position.
Figure 7:
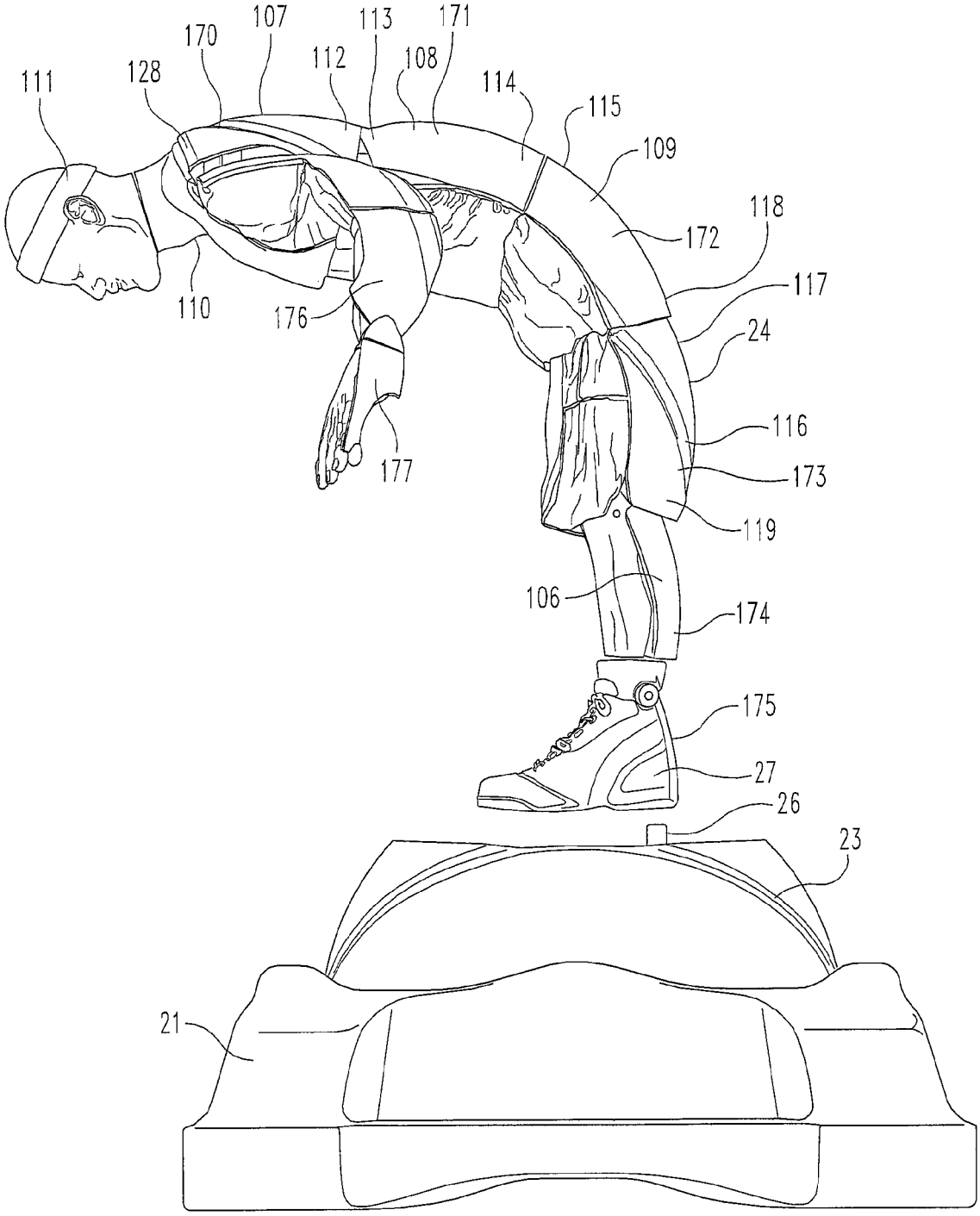
FIG. 7 is the same view as FIG. 6 only showing the container top portion in a more expanded position.

Referring to FIG. 5, container top portion 24 is shown being slightly unfolded with the arms 101 and 102 of the man extending outward. In FIGS. 6 & 7, the container top portion is further unfolded until the figurine is completely unfolded and erect in FIG. 8. The members of the figurine are pivotably connected to adjacent members allowing the figurine to collapse forming the container top portion. For example, hands 103 and 104 are pivotally connected respectively to arms 101 and 102.

The figurine depicts a man having a torso composed of a shoulder torso portion 107 (FIG. 6) pivotally connected to a middle torso portion 108, in turn, pivotally connected to a lower torso portion 109 and, in turn, pivotally connected to thigh 116. The outer surfaces that face rearwardly of the man form the outer surface 43 (FIG. 2) of the container portion 24 along with various surfaces of the appendages of the man including arms, hands, legs and feet.

Shoulder torso portion 107 has an upper end 128 (FIG. 7) including a pair of inwardly located spaced apart walls that pivotally receive the bottom end of neck 110. A pin extends through the spaced apart walls of shoulder torso portion 107 and through the bottom portion of the neck thereby allowing the head and neck to pivot relative to the torso.

Many variations are contemplated and included by the present invention for connecting the various components of the figurine together such as a pinned connection or living hinge connection with the main objective being to allow one component such as the head to pivot relative to another component such as shoulder torso portion 107. The head 111 may be integral with the neck 110 of the figurine or alternatively may have a downwardly projecting ball shaped member that projects into a socket in the upper end of neck 110 to allow the head to rotate relative to the neck.

The bottom 112 (FIG. 7) of shoulder torso portion 107 is pivotally pinned to the upper end 113 of middle torso portion 108 to allow the two portions to pivot relative to each other. Likewise, the bottom end 114 of middle torso portion 108 is pivotally pinned to the upper end 115 of lower torso portion 109 to allow the middle torso portion 108 and lower torso portion 109 to pivot relative to each other. The thigh 116 has an upper end 117 pivotally pinned to the lower end 118 of lower torso portion 109 with the separate legs pivotally attached to the bottom end 119 of the thigh 116. Shoulder torso portion 107, middle torso portion 108, lower torso portion 109 and thigh 116 form the components making up the torso.

In the completely collapsed condition, the rearwardly facing surfaces 170, 171, 172 and 173 of respectively components 107, 108, 109 and 116 extend through a 180 degree arch forming the outer surface 43 of the container top portion 24 in cooperation with the rearwardly facing surfaces 174, 175, 176 and 177 respectively of the legs, feet, arms and hands which complete the outer surface 43 of the container top portion. As the figurine is collapsed, the legs, feet, arms and hands pivot inwardly within the 180 degree arc formed by components 107, 108, 109 and 116 aligning surfaces 174-177 with surfaces 170-173 forming surface 43.

Legs 105 and 106 (FIG. 5) are spaced apart. Leg 105 will now be described it being understood that a similar description applies to leg 106. Leg 105 has a top end 120 pivotally pinned to interior bracket 121 formed in the interior of thigh 116. Leg 105 pivots around bracket 121 from the partially collapsed position (FIG. 5) through the partially erect positions of FIGS. 6 and 7 to the completely erect position of FIG. 8. Arrow 122 (FIG. 8) illustrates the pivot action of the legs relative to the thigh. The bottom ends of legs 105 and 106 have feet 130 and 131 (FIG. 5) pivotally mounted by means of a pin connection between the upper end of each foot and the lower end of each leg. Alternatively, the feet may be designed to swivel with respect to the legs by having for example a ball shaped rod integrally connected to the bottom of each leg projecting into a complementary receiving socket formed in the top end of each foot.

Arms 101 and 102 (FIG. 5) have pivot connections at each shoulder, elbow and wrist with hands 103 and 104 pivotally connected respectively to the wrists. Arm 102 and hand 104 will now be described it being understood that an identical description applies to arm 101 and hand 103. The term arm is used herein consists of the upper arm and the forearm which extends to the wrist. Arm 102 has an upper arm or bicep 148 (FIG. 8) with a top end 140 pivotally connected to the extension of 141 shoulder 107 whereas the bottom end 142 of the upper arm is pivotally connected to the upper end 143 of forearm 144. The pivot connection between bicep 148 and forearm 144 may also include a rotatable connection between the bicep and forearm allowing the forearm to not only pivot but also rotate with respect to the bicep to more compactly fold the arm into the top portion 24. In such a case, the bicep 148 may include a member with a bottom end rotatably received in a socket of the forearm 144 with the top end of the member being pivotally pinned to the bicep. The bottom end 145 of forearm 144 is pivotally connected to wrist 149 in turn rotatably connected to hand 104.

Figure 8:
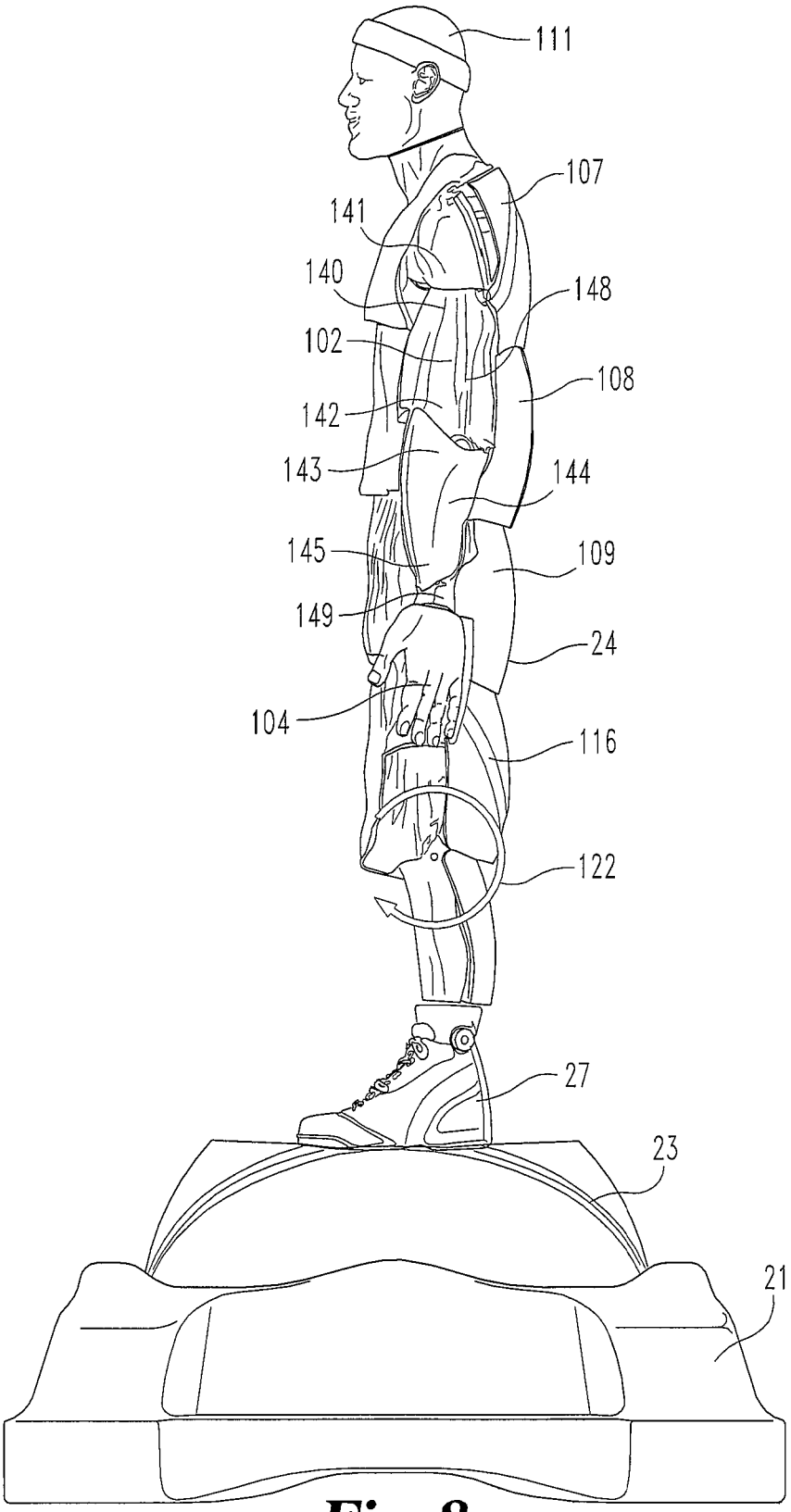
FIG. 8 is the same view as FIG. 6 only showing the container top portion completely expanded to form a figurine mounted atop the platform of the container bottom portion.

The soles of each foot 130 and 131 (FIG. 5) have a downwardly opening hole to receive the pair of pegs 26 (FIG. 4) to hold the figurine in an erect position (FIG. 8).

The toy consists of a platform 21 and a container 22. The container consists of a shell or lower portion 23 and a upper portion 24 erectable to form a figurine having a collapsed position/state and an erect position/state. The figurine has a main body or torso with appendages articulately secured to the main body or torso of the figurine that may be manually articulated to position the figurine in a collapsed position and in an erect position as well as positions therebetween. The figurine has an outwardly facing surface when in the collapsed position that is alignable with the outside surface of the shell to cooperatively form the container 22 to enclose the figurine within the container except for the outwardly facing surfaces of the figurine. That is, shoulder 107 has an outwardly facing surface 170, middle torso portion has an outwardly facing surface 171, lower torso portion 109 has an outwardly facing surface 115, thigh 116 has an outwardly facing surface 173, legs 105 and 106 have outwardly facing surfaces 174, feet 130 and 131 have outwardly facing surfaces 175, arms 101 and 102 have outwardly facing surfaces 176, and hands 102 and 103 having outwardly facing surfaces 177 that when collapsed form a semi-spherical surface 43 (FIG. 2) alignable with the semi-spherical surface 161 of container bottom portion 23.

The figurine formed by the container top portion 24 is releasably lockable with the container bottom portion 23 which forms the container when tabs 30 and 31 are each pushed inwardly engaging slots in top portion 24, along with tabs 34 and 35 engaging the container top portion 24. The figurine man is completely enclosed in the container top portion except for the outwardly facing surfaces forming the outer container surface and except for the head 111 which is located within the hollow interior 28 of the container bottom portion.

To play with the toy, one lifts upward and separates container 22 from stand 21. Container top portion 24 is pulled apart from container bottom portion 23 by squeezing the side walls of container bottom portion 23 disengaging tabs 30 and 31 from the container top portion. Container bottom portion 23 is then inverted and tabs 30 and 31 are inserted into slots 150 and 151 with platform 25 then being rotated to position pegs 26 to face upwardly (FIG. 3-4). Container top portion 24 is then unfolded from the figurine stored position through the progressively unfolded positions of FIGS. 5-7 until in the completely erect position of FIG. 8. The soles of the feet of the figurine are positioned to receive pegs 26 thereby mounting the figurine to the platform. The various members, such as, legs, arms, hands, and head, may then be moved to various positions. In order to return the figurine within the container, the various steps enumerated are reversed.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A toy comprising:

a container with a bottom portion and a top portion; and wherein:

said bottom portion of said container has a bottom rounded outside surface forming a shell and a hollow interior;

said top portion has a top rounded outwardly facing surface and is mountable to said bottom portion forming said container, said top portion forming a figurine having a collapsed position and an erect position, said figurine having a main body with articulatable members that may be manually moved to position said figurine in said collapsed position and in said erect position, said figurine forming said top rounded outwardly facing surface when in said collapsed position alignable with said bottom rounded outside surface of said bottom portion to cooperatively form the container concealing said figurine within the container except for said top rounded outwardly facing surface, said top portion and said bottom portion are lockable together when said figurine is in said collapsed position with said figurine being mountable on said bottom portion and also separable from said bottom portion;

said articulatable members having joints allowing one articulatable member to be moved with respect to another articulatable member when said figurine is in said erect position and also when said figurine is moved from said erect position toward said collapsed position and vice versa, some of said articulatable members have member outwardly facing surfaces forming said top rounded outwardly facing surface when said articulatable members are moved to position said figurine in said collapsed position, said articulatable members are concealed within said top rounded outwardly facing surface when in said collapsed position; and, said bottom portion has a main portion and a platform movably mounted on said main portion and cooperatively forming said bottom rounded outside surface when said figurine is in said collapsed position with said platform movable to face upwardly to mountingly receive said figurine when said bottom portion is disconnected from top portion and inverted.

2. The toy of claim 1 wherein:

said figurine has a portion thereof which fits into said shell when locked to said bottom portion.

3. The toy of claim 1 wherein:

said figurine and said bottom portion have interlocking supports to releasably hold said figurine in said erect position.

4. The toy of claim 1 wherein:

said bottom portion has a first catch engaged with said top portion and lockable together when said figurine is in the collapsed position.

5. The toy of claim 3 wherein:

said platform is rotatable with a first side having a curved surface forming a segment of said bottom rounded outside surface of said bottom portion and a second side opposite of said first side with pegs thereon to receive said figurine.

6. The toy of claim 5 wherein:

said container has a ball shape and said figurine is shaped as a human with said bottom rounded outside surface including said curved surface of said platform and said top rounded outwardly facing surface of said top portion cooperatively forming said ball shape when said figurine is in said collapsed position.

7. A toy comprising:

a statuette with movable appendages allowing said statuette to move from a collapsed position to an erect position and vice versa, said statuette having rounded portions which face outwardly in said collapsed position forming a first shell;

a second shell removably mounted to said statuette to form a container composed of said first shell and said second shell having an external surface with a ball shape; and, a stand having an upwardly facing cavity to receive and hold said container when said statuette is in said collapsed position and to hold said second shell when said statuette is in an erect position, said stand having mounting means to receive said second shell when said second shell is inverted and said statuette is in said erect position and mounted to said second shell.

8. The toy of claim 7 wherein:

said appendages include manually movable arms, legs, and head to fit within said container when said statuette is in said collapsed position, said statuette and said second shell each have outwardly facing surfaces that are alignable together to form said external surface of said container.

9. The toy of claim 8 wherein:

said second shell has a rotatable portion forming a platform upon which said statuette is mountable in an erect position, said platform has an external rounded surface alignable with said external surface of said second shell which cooperatively with said statuette form said ball shape.

10. A toy comprising a first shell and a second shell matable together forming a container with a container rounded outside surface extending around said container forming a ball shape, and wherein:

said first shell has a statuette with a collapsed position and an erect position, said statuette has articulable members movable with respect to each other, said articulable members are positioned within and form said first shell when in said collapsed position and are extendable outwardly thereof when in said erect position, said articulable members having first rounded surfaces forming a first shell outside surface when said statuette is in said collapsed position, said second shell includes a main portion and a platform movably mounted thereto having a statuette mounting position and a stored position, said platform further having mounting devices to mountingly receive said statuette when said statuette is erect and said platform is in said statuette mounting position, said main portion of said second shell has a second rounded outside surface and said platform has a platform rounded surface which together form with said first rounded surface of said statuette said ball shape;

and further comprising:

a stand with a cavity to receive and hold said container when said statuette is in said collapsed position, said stand further holds said second shell when said second shell is inverted and said statuette is in said erect position and mounted to said platform in said statuette mounting position.

11. The toy of claim 10 wherein:

said statuette includes a portion extending into said second shell when said first shell and said second shell are mated together forming said container.

* * * * *